US012800186B2

(12) United States Patent
Liu et al.

(10) Patent No.: US 12,800,186 B2
(45) Date of Patent: Nov. 17, 2026

(54) HEAT EXCHANGER ASSEMBLY AND AIR CONDITIONING SYSTEM HAVING THE HEAT EXCHANGER ASSEMBLY

(71) Applicant: Danfoss A/S, Nordborg (DK)

(72) Inventors: Yubao Liu, Zhejiang (CN); Lisha Chen, Zhejiang (CN)

(73) Assignee: DANFOSS A/S, Nordborg (DK)

( * ) Notice: Subject to any disclaimer, the term of this patent is extended or adjusted under 35 U.S.C. 154(b) by 0 days.

(21) Appl. No.: 18/711,735

(22) PCT Filed: Nov. 18, 2022

(86) PCT No.: PCT/CN2022/132756
§ 371 (c)(1),
(2) Date: May 20, 2024

(87) PCT Pub. No.: WO2023/093624
PCT Pub. Date: Jun. 1, 2023

(65) Prior Publication Data

US 2025/0012482 A1 Jan. 9, 2025

(30) Foreign Application Priority Data

Nov. 26, 2021 (CN) ..... 202111428085.X

(51) Int. Cl.
*F24F 13/30* (2006.01)
*F24F 11/67* (2018.01)
(Continued)

(52) U.S. Cl.
CPC ..... *F24F 13/30* (2013.01); *F24F 11/67* (2018.01); *F24F 11/84* (2018.01); *F28F 9/0204* (2013.01)

(58) Field of Classification Search
CPC ..... F24F 13/30; F24F 11/84; F28D 1/05383; F28D 1/05391; F25B 39/00; F28F 27/02; F28F 9/26; F28F 2250/06
See application file for complete search history.

(56) References Cited

U.S. PATENT DOCUMENTS 5,305,826 A * 4/1994 Couetoux ..... F28F 27/02 123/41.1
2003/0188859 A1* 10/2003 Muramoto ..... F28F 9/0202 165/140
(Continued)

FOREIGN PATENT DOCUMENTS

CN 103206811 A * 7/2013
CN 104949318 A 9/2015
(Continued)

OTHER PUBLICATIONS

International Search Report mailed on Feb. 11, 2023, in connection with corresponding International Application No. PCT/CN2022/132756, 6 pages.
(Continued)

*Primary Examiner* — Lionel Nouketcha
(74) *Attorney, Agent, or Firm* — McCormick, Paulding & Huber PLLC

(57) ABSTRACT

A heat exchanger assembly and an air conditioning system having the heat exchanger assembly. The heat exchanger assembly includes: a first heat exchanger portion and a second heat exchanger portion; and a control valve, the control valve having an open position and a closed position, at the open position, the first heat exchanger portion being in fluid communication with the second heat exchanger portion by means of the control valve, and at the closed position, the first heat exchanger portion being in fluid isolation with the second heat exchanger portion by means
(Continued)

of the control valve. By using the heat exchanger assembly of the present disclosure, performance of the air conditioning system can be improved.

20 Claims, 9 Drawing Sheets

(51) Int. Cl.
*F24F 11/84* (2018.01)
*F28F 9/02* (2006.01)

(56) References Cited

U.S. PATENT DOCUMENTS

2016/0054077 A1* 2/2016 Saito ..... F28F 9/0209 165/173
2017/0307301 A1* 10/2017 Sørensen ..... F28F 27/02
2019/0309965 A1 10/2019 Goel et al.
2020/0191489 A1* 6/2020 Kim ..... F28D 1/05325

FOREIGN PATENT DOCUMENTS

CN 105352344 A 2/2016
CN 105953360 A 9/2016
CN 106642470 A 5/2017
CN 110425722 A 11/2019
CN 112437856 A 3/2021
CN 113137673 A * 7/2021 ..... F24F 11/64

OTHER PUBLICATIONS

Li, Xiangfeng. (2006). Chapter 3 Basic Structure of Automotive Air Conditioning Refrigeration System. In Automotive Air Conditioning (pp. 41). Xi'an University of Electronic Science and Technology Press.

* cited by examiner

HEAT EXCHANGER ASSEMBLY AND AIR CONDITIONING SYSTEM HAVING THE HEAT EXCHANGER ASSEMBLY

CROSS-REFERENCE TO RELATED APPLICATIONS

This application is a National Stage application of International Patent Application No. PCT/CN2022/132756, filed on Nov. 18, 2022, which claims priority to Chinese Patent Application No. 202111428085.X, filed on Nov. 26, 2021, each of which is hereby incorporated by reference in its entirety.

TECHNICAL FIELD

Embodiments of the present invention relate to a heat exchanger assembly and an air conditioning system having the heat exchanger assembly.

BACKGROUND ART

An air conditioning system with a reheater can operate in a refrigeration mode and a reheating mode. In the refrigeration mode, the refrigerant flows through the condenser but not through the reheater. In the reheating mode, the refrigerant needs to flow through the condenser and the reheater.

SUMMARY

An objective of the embodiments of the present invention is to provide a heat exchanger assembly and an air conditioning system with the heat exchanger, thereby, for example, improving the performance of the air conditioning system.

Embodiments of the present invention provide a heat exchanger assembly comprising: a first heat exchanger portion and a second heat exchanger portion; and a control valve, the control valve having an open position and a closed position, at the open position, the first heat exchanger portion being in fluid communication with the second heat exchanger portion by means of the control valve, and at the closed position, the first heat exchanger portion being in fluid isolation with the second heat exchanger portion by means of the control valve.

According to an embodiment of the present invention, the first heat exchanger portion and the second heat exchanger portion are respectively a first heat exchanger portion and a second heat exchanger portion of a heat exchanger, the heat exchanger comprising a plurality of heat exchange tubes and two header tubes connected to the two ends of each heat exchange tube and in fluid communication with each other, wherein each of the two header tubes comprises a first header tube portion and a second header tube portion that are in fluid isolation from each other, so that the heat exchanger is separated into a first heat exchanger portion and a second heat exchanger portion that are in fluid isolation from each other, and the control valve connects the first header tube portion and the second header tube portion of one of the two header tubes to connect the first heat exchanger portion and the second heat exchanger portion in series.

According to an embodiment of the present invention, the heat exchanger further comprises a partition arranged in each of the two header tubes, the partition separating each header tube into the first header tube portion and the second header tube portion that are in fluid isolation from each other.

According to an embodiment of the present invention, the heat exchanger further comprises a partition arranged in one of the two header tubes, the partition separating the first header tube into the first header tube portion and the second header tube portion that are in fluid isolation from each other, and the first header tube portion and the second header tube portion of the other of the two header tubes are two subheader tubes that are in fluid isolation from each other.

According to an embodiment of the present invention, the first header tube portion and the second header tube portion of the header tube in two header tubes are two subheader tubes that are in fluid isolation from each other, and the heat exchanger further comprises a partition arranged in the other of the two header tubes, the partition separating the other header tube into the first header tube portion and the second header tube portion that are in fluid isolation from each other.

According to an embodiment of the present invention, the control valve is arranged inside the header tube and installed on the partition inside the header tube.

According to an embodiment of the present invention, the control valve is arranged outside the header tube and connected to a first header tube portion and a second header tube portion of the header tube through a connecting tube.

According to an embodiment of the present invention, the heat exchanger assembly further comprises: a first storage container, the first storage container being in fluid communication with a second header tube portion of the first header tube and connected between the control valve and a second header tube portion of the first header tube.

According to an embodiment of the present invention, the heat exchanger assembly further comprises a second storage container, the second storage container being in fluid communication with a second header tube portion of the other of the two header tubes, and the outlet of the heat exchanger is arranged on the second storage container.

According to an embodiment of the present invention, the number of heat exchange tubes connected to the second header tube portion is greater than the number of heat exchange tubes connected to the first header tube portion, and the inlet and the outlet of the heat exchanger are respectively connected to and in fluid communication with the first heat exchanger portion and second heat exchanger portion.

According to an embodiment of the present invention, the first heat exchanger portion and the second heat exchanger portion are two heat exchangers, and the control valve is connected between the two heat exchangers to connect them in series.

According to an embodiment of the present invention, at least one of the two heat exchangers is a microchannel heat exchanger or a finned tube heat exchanger.

According to an embodiment of the present invention, the control valve is a one-way valve, the one-way valve allowing only a refrigerant in the first heat exchanger portion to flow into the second heat exchanger portion by means of the one-way valve.

According to an embodiment of the present invention, the control valve is a two-position two-way valve.

According to an embodiment of the present invention, at the open position, the first heat exchanger portion is connected in series to the second heat exchanger portion.

An embodiment of the present invention further provides a heat exchanger assembly comprising a heat exchanger having an inlet and an outlet; and a control valve connected to the inlet of the heat exchanger and having an open position and a closed position, wherein, at the open position, the control valve allows a refrigerant to enter the heat exchanger by means of the control valve and the inlet of the heat exchanger, and at the closed position, the control valve closes the inlet of the heat exchanger.

An embodiment of the present invention further provides an air conditioning system comprising a reheater, which is the above-described heat exchanger assembly.

According to an embodiment of the present invention, the air conditioning system further comprises a compressor; a first heat exchanger functioning as one of a condenser and an evaporator; and a second heat exchanger functioning as the other of a condenser and an evaporator; the compressor, the first heat exchanger, and the second heat exchanger are connected in sequence from the compressor through the first heat exchanger to the second heat exchanger, and the reheater is connected in parallel to the first heat exchanger.

According to an embodiment of the present invention, in the refrigeration mode, the first heat exchanger functions as a condenser and the second heat exchanger functions as an evaporator, the reheater does not operate and the control valve of the reheater is closed, so that a portion of the refrigerant flowing from the first heat exchanger to the second heat exchanger flows into the second heat exchanger portion of the reheater and is stored in the second heat exchanger portion.

According to an embodiment of the present invention, in the reheating mode, the first heat exchanger functions as a condenser and the second heat exchanger functions as an evaporator, the reheater operates and the control valve of the reheater opens, so that the refrigerant flows into the first heat exchanger portion of the reheater and from the first heat exchanger portion to the second heat exchanger portion by means of the control valve.

According to an embodiment of the present invention, the first heat exchanger portion is arranged above the second heat exchanger portion.

According to an embodiment of the present invention, the first heat exchanger portion and the second heat exchanger portion are two heat exchangers, and the heat exchanger functioning as the first heat exchanger portion is arranged above the heat exchanger functioning as the second heat exchanger portion.

According to an embodiment of the present invention, the first heat exchanger portion and the second heat exchanger portion are two heat exchangers arranged side by side in a horizontal direction.

An embodiment of the present invention further provides an air conditioning system comprising a reheater, which is the above-described heat exchanger assembly.

According to an embodiment of the present invention, the air conditioning system further comprises a compressor; a first heat exchanger functioning as one of a condenser and an evaporator; and a second heat exchanger functioning as the other of a condenser and an evaporator; the compressor, the first heat exchanger, and the second heat exchanger are connected in sequence from the compressor through the first heat exchanger to the second heat exchanger, and the reheater is connected in parallel to the first heat exchanger.

According to an embodiment of the present invention, in the refrigeration mode, the first heat exchanger functions as a condenser and the second heat exchanger functions as an evaporator, the reheater does not operate and the control valve of the reheater is closed, so that a portion of the refrigerant flowing from the first heat exchanger to the second heat exchanger is diverted into the reheater and stored in the reheater.

According to an embodiment of the present invention, in the reheating mode, the first heat exchanger functions as a condenser, and the second heat exchanger functions as an evaporator, the reheater operates and the control valve of the reheater opens, so that the refrigerant flows into the reheater by means of the control valve.

An embodiment of the present invention further provides an air conditioning system comprising a compressor; a first heat exchanger functioning as one of a condenser and an evaporator; a second heat exchanger functioning as the other of a condenser and an evaporator; and a reheater connected in parallel to the first heat exchanger; the compressor, the first heat exchanger, and the second heat exchanger are connected in sequence from the compressor through the first heat exchanger to the second heat exchanger, and in the refrigeration mode, the first heat exchanger functions as a condenser and the second heat exchanger functions as an evaporator, the reheater does not operate, and a portion of the refrigerant flowing from the first heat exchanger to the second heat exchanger flows into the reheater and is stored in at least a portion of the reheater.

According to an embodiment of the present invention, the reheater is a heat exchanger assembly as described above.

By using a heat exchanger assembly according to an embodiment of the present invention and an air conditioning system having the heat exchanger assembly, performance of the air conditioning system may be improved, for example.

DETAILED DESCRIPTION

Figure 1:
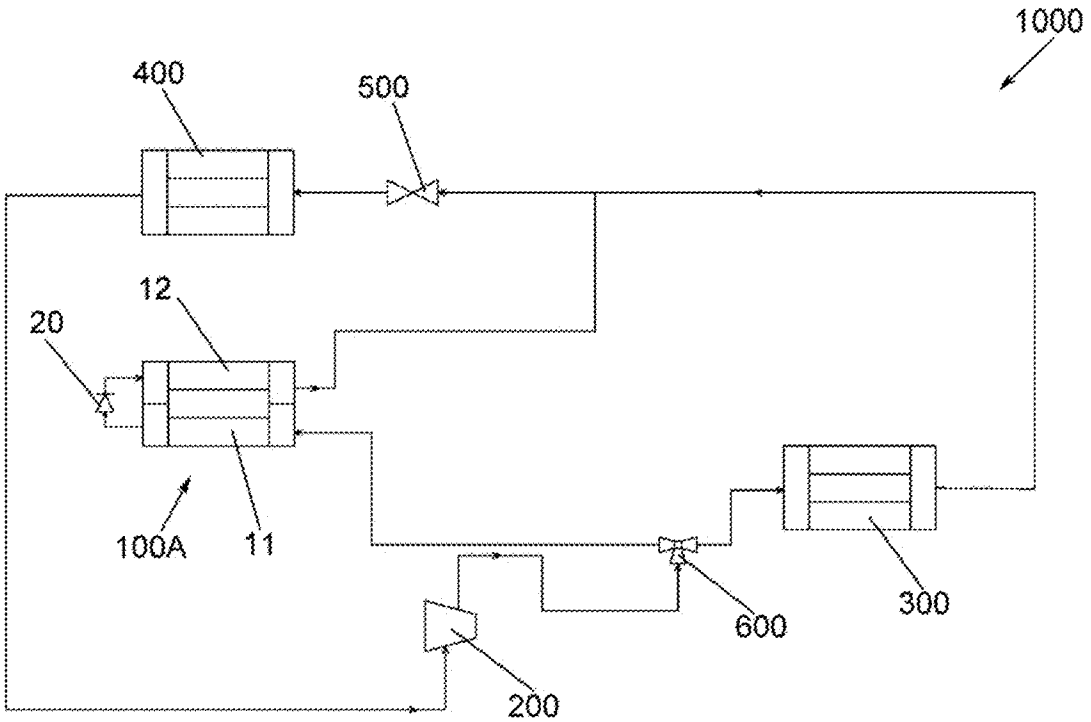
FIG. 1 is a schematic diagram of an air conditioning system according to an embodiment of the present invention.

The present invention will be described below in further detail in conjunction with the drawings and specific embodiments.

A heat exchanger assembly according to an embodiment of the present invention will be described first.

Referring to FIG. 1 to FIG. 8, a heat exchanger assembly 100 according to an embodiment of the present invention comprises a first heat exchanger portion 11 and a second heat exchanger portion 12; and a control valve 20, the control valve 20 having an open position and a closed position, at the open position, the first heat exchanger portion 11 being in fluid communication with the second heat exchanger portion 12 by means of the control valve 20, and at the closed position, the first heat exchanger portion 11 being in fluid isolation with the second heat exchanger portion 12 by means of the control valve 20. At the open position, the first heat exchanger portion 11 is connected in series to the second heat exchanger portion 12. The control valve may be a one-way valve as shown in the drawings, the one-way valve allowing only a refrigerant in the first heat exchanger portion 11 to flow into the second heat exchanger portion 12 by means of the one-way valve, while the refrigerant in the second heat exchanger portion 12 cannot flow into the first heat exchanger portion 11 by means of the one-way valve. A one-way valve may be in a common form in the prior art, for example, being openable one way only under a certain pressure difference to achieve a one-way sealing function. The control valve 20 connects the first heat exchanger portion 11 and the second heat exchanger portion 12, so that the refrigerant in the first heat exchanger portion 11 can flow into the second heat exchanger portion 12, while the refrigerant in the second heat exchanger portion 12 cannot flow into the first heat exchanger portion 11. The control valve may also be a two-position two-way valve, etc.

Figure 2:
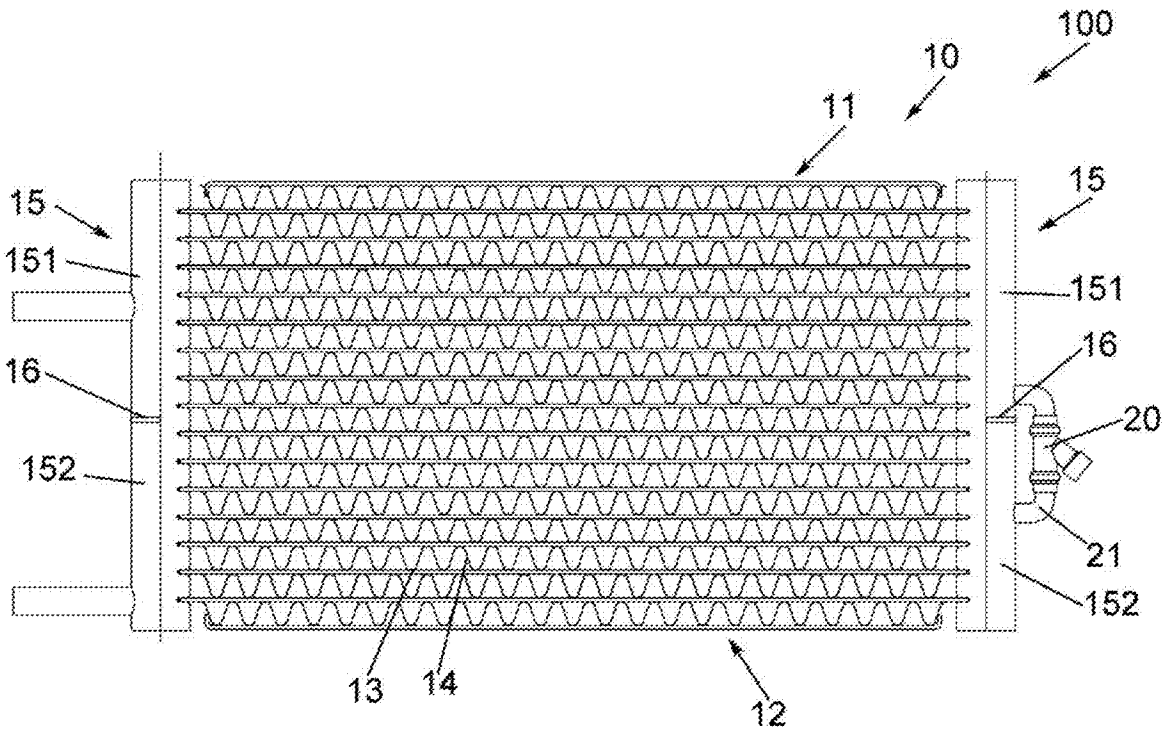
FIG. 2 is a schematic diagram of a heat exchanger assembly according to an embodiment of the present invention.
Figure 3:
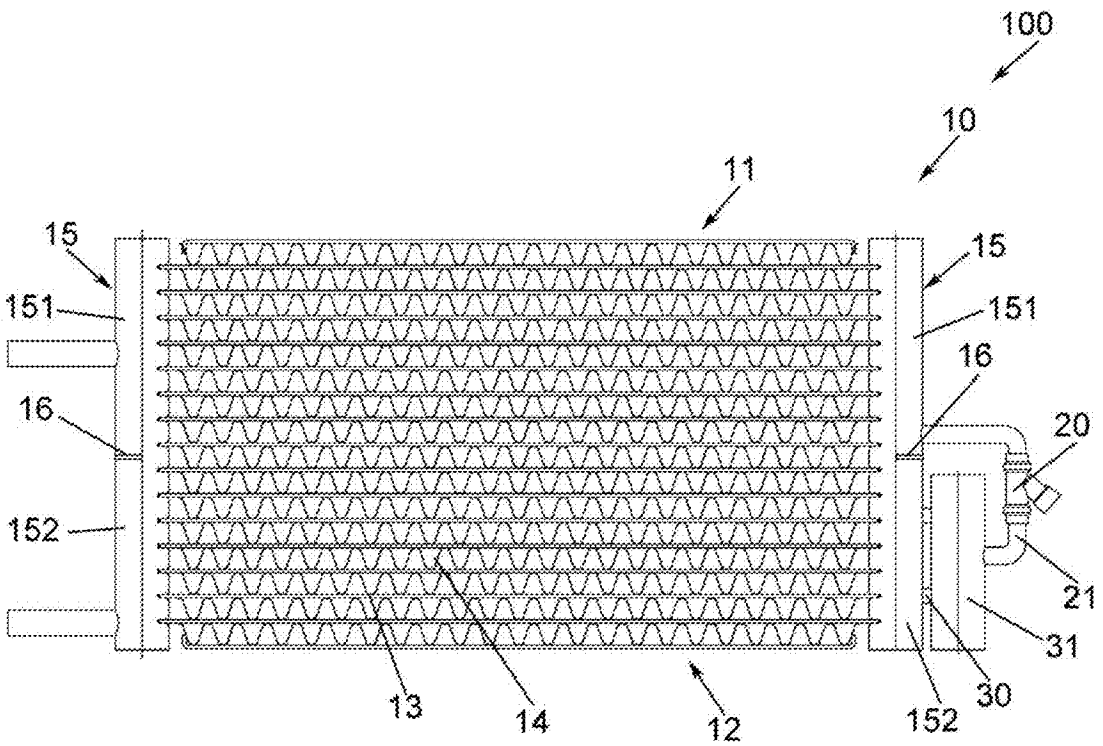
FIG. 3 is a schematic diagram of a heat exchanger assembly according to a variant of one embodiment of the present invention.
Figure 4:
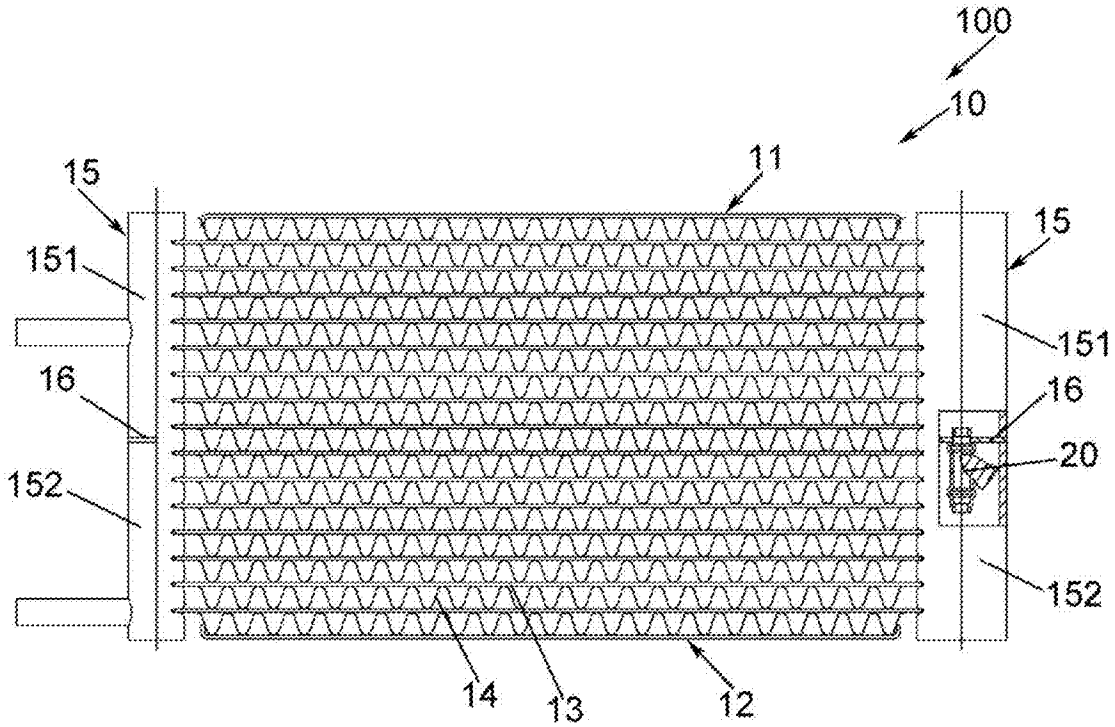
FIG. 4 is a schematic diagram of a heat exchanger assembly according to another variant of one embodiment of the present invention.
Figure 5:
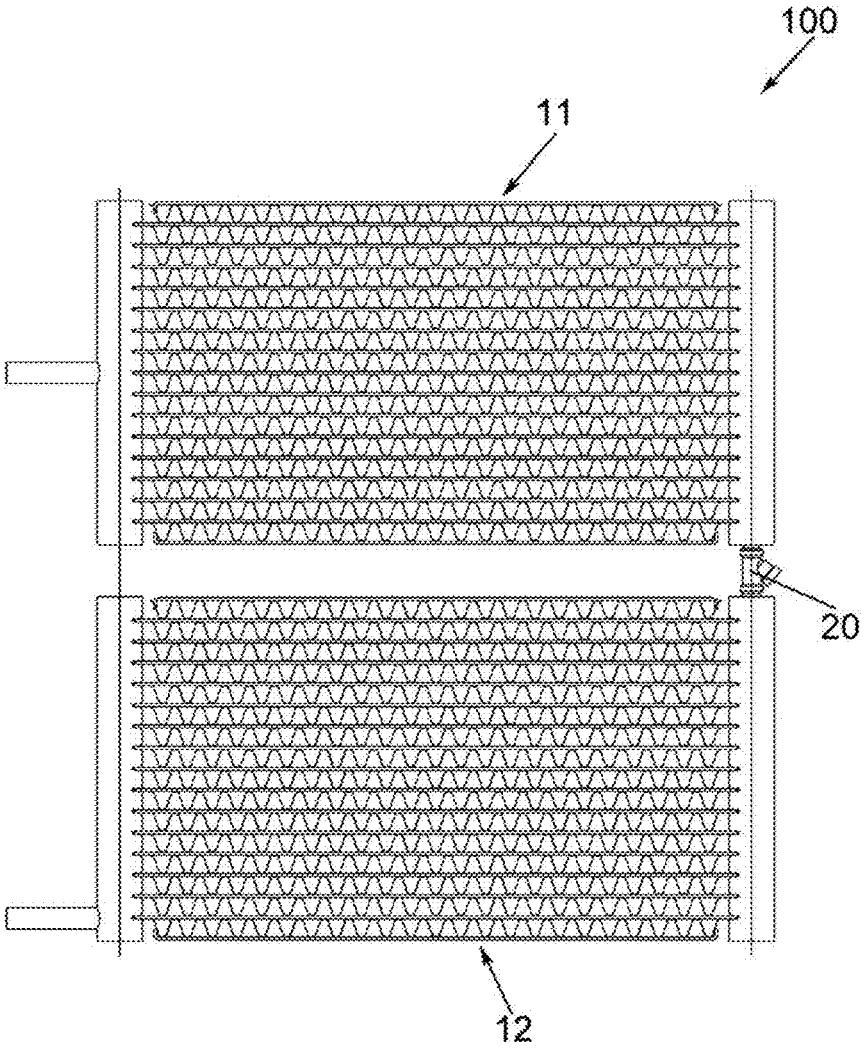
FIG. 5 is a schematic diagram of a heat exchanger assembly according to another embodiment of the present invention.
Figure 6:
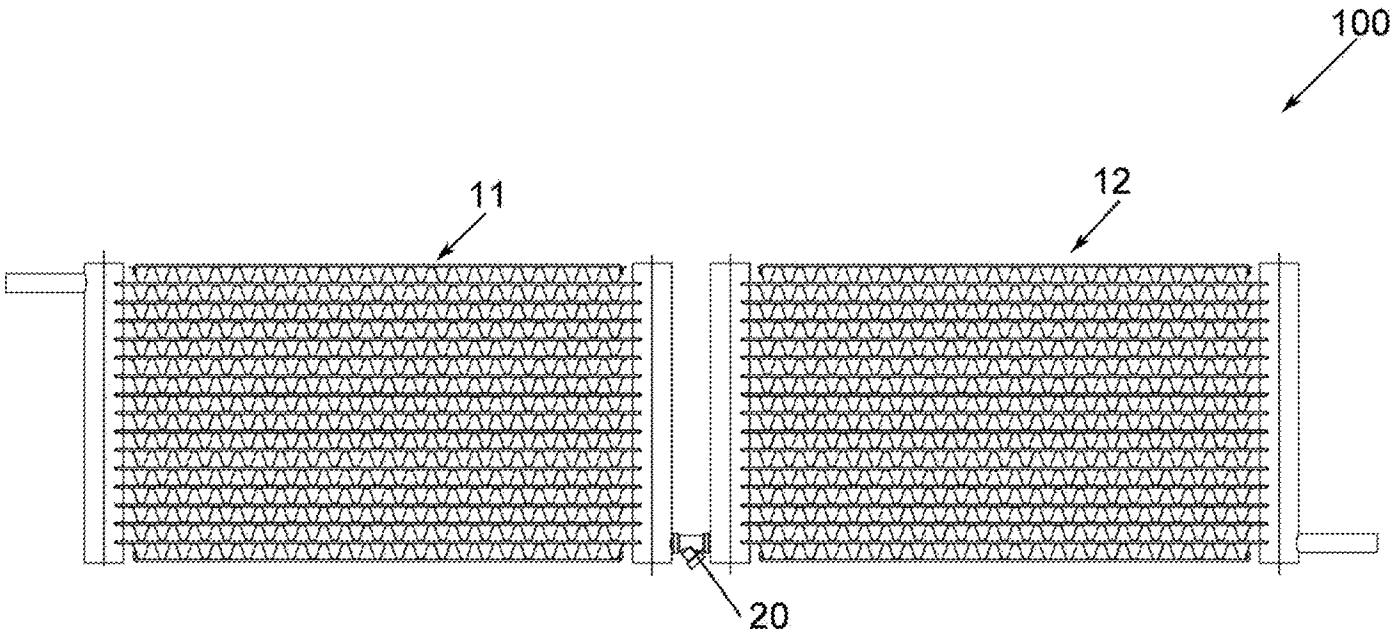
FIG. 6 is a schematic diagram of a heat exchanger assembly according to a variant of another embodiment of the present invention.

Referring to FIG. 2 to FIG. 4, in some embodiments of the present invention, the first heat exchanger portion 11 and the second heat exchanger portion 12 are respectively the first heat exchanger portion 11 and the second heat exchanger portion 12 of the heat exchanger 10, the heat exchanger 10 comprising a plurality of heat exchange tubes 13, fins 14 arranged alternately with a plurality of heat exchange tubes 13, and two header tubes 15 connected to and in fluid communication with the two ends of each heat exchange tube 13, wherein each header tube 15 in the two header tubes 15 comprises a first header tube portion 151 and a second header tube portion 152 that are in fluid isolation from each other, so that the heat exchanger is separated into a first heat exchanger portion 11 and a second heat exchanger portion 12 that are in fluid isolation from each other, and the control valve 20 connects the first header tube portion 151 and the second header tube portion 152 of one of the two header tubes 15 to connect the first heat exchanger portion 11 and the second heat exchanger portion 12 in series. The inlet and the outlet of the heat exchanger 10 are respectively connected to and in fluid communication with the first heat exchanger portion 11 and the second heat exchanger portion 12, wherein, for example, the inlet and the outlet of the heat exchanger 10 are arranged on the other header tube 15 and are connected to and in fluid communication with the first header tube portion 151 and the second header tube portion 152, respectively. In the embodiments shown in FIG. 2 to FIG. 4, the heat exchanger is a microchannel heat exchanger.

Referring to FIG. 2 to FIG. 4, in some embodiments of the present invention, the heat exchanger 10 further comprises a partition 16 provided in each of the two header tubes 15, the partition 16 separating each header tube 15 into the first header tube portion 151 and the second header tube portion 152 that are in fluid isolation from each other.

Referring to FIGS. 2 to 4, in some other embodiments of the present invention, the heat exchanger 10 further comprises a partition 16 provided in one of the two header tubes 15, the partition 16 separating the one header tube 15 into the first header tube portion 151 and the second header tube portion 152 that are in fluid isolation from each other, and the first header tube portion 151 and the second header tube portion 152 of the other of the two header tubes 15 are two subheader tubes that are in fluid isolation from each other.

Referring to FIG. 2 to FIG. 4, in still some other embodiments of the present invention, the first header tube portion 151 and the second header tube portion 152 of one of the two header tubes 15 are two subheader tubes that are in fluid isolation from each other, and the heat exchanger 10 further comprises a partition 16 provided in the other of the two header tubes 15, the partition 16 separating the other header tube 15 into the first header tube portion 151 and the second header tube portion 152 that are in fluid isolation from each other.

Referring to FIG. 4, in some embodiments of the present invention, the control valve 20 is provided inside the header tube 15 and installed on the partition 16 inside the header tube 15. Referring to FIG. 2 and FIG. 3, in some other embodiments of the present invention, the control valve 20 is arranged on the outside of the header tube 15 and is connected to the first header tube portion 151 and the second header tube portion 152 of the header tube 15 through a connecting tube 21.

In order to increase the volume of the second heat exchanger portion 12, as shown in FIG. 3, in some embodiments of the present invention, the heat exchanger assembly 100 may further comprise a first storage container 31, the first storage container 31 being in fluid communication with the second header tube portion 152 of the header tube 15 (for example, through a connecting tube 30), and connected between the control valve 20 and the second header tube portion 152 of the header tube 15. The refrigerant in the first heat exchanger portion 11 can flow into the second heat exchanger portion 12 by means of the first storage container 31 and the control valve 20. In some other embodiments of the present invention, the heat exchanger assembly 100 may further comprise a second storage container in fluid communication with the second header tube portion 12 of the other header tube 15 of the two header tubes 15, and the outlet of the heat exchanger 10 is arranged on the second storage container. The heat exchanger assembly 100 may comprise only a first storage container 31 or a second storage container, or may comprise both a first storage container 31 and a second storage container. In addition, the number of heat exchange tubes 13 connected to the second header tube portion 152 may be greater than the number of heat exchange tubes 13 connected to the first header tube portion 151. Further, the ratio between the second heat exchanger portion 12 and the first heat exchanger portion 11 may be increased.

Figure 7:
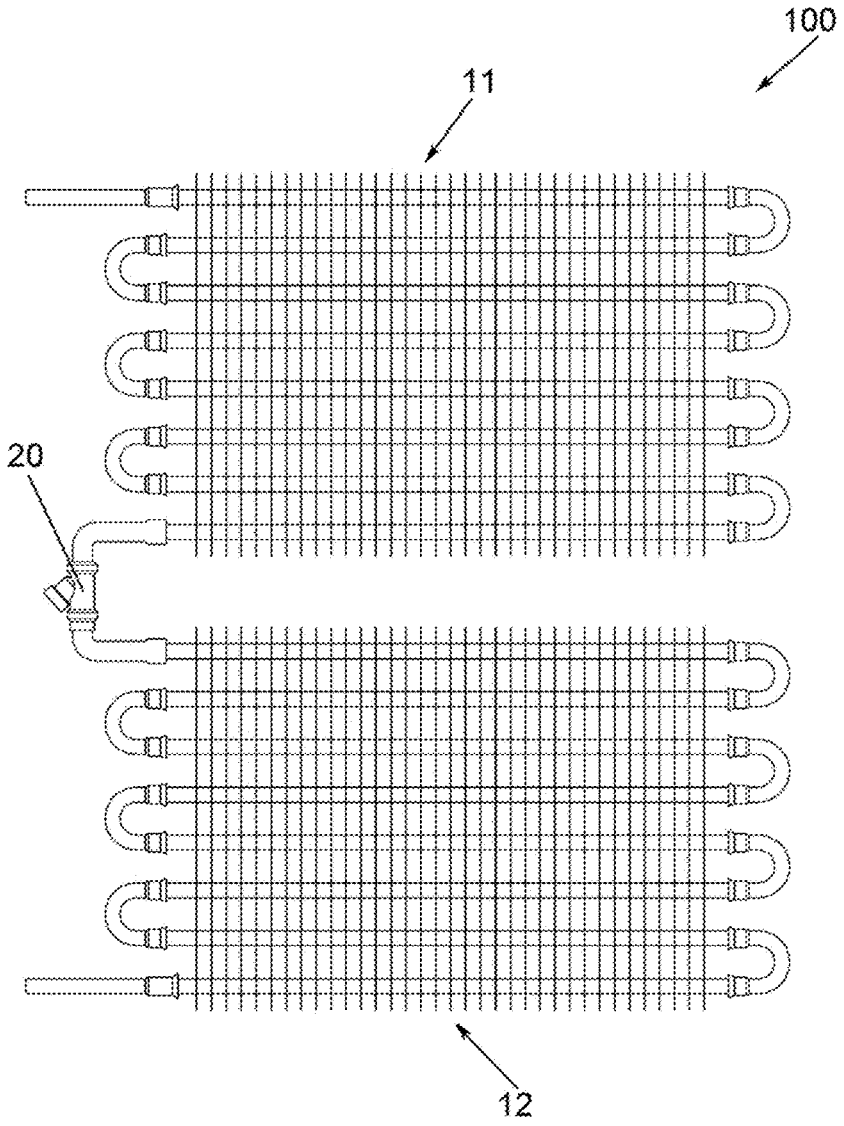
FIG. 7 is a schematic diagram of a heat exchanger assembly according to another variant of another embodiment of the present invention.
Figure 8:
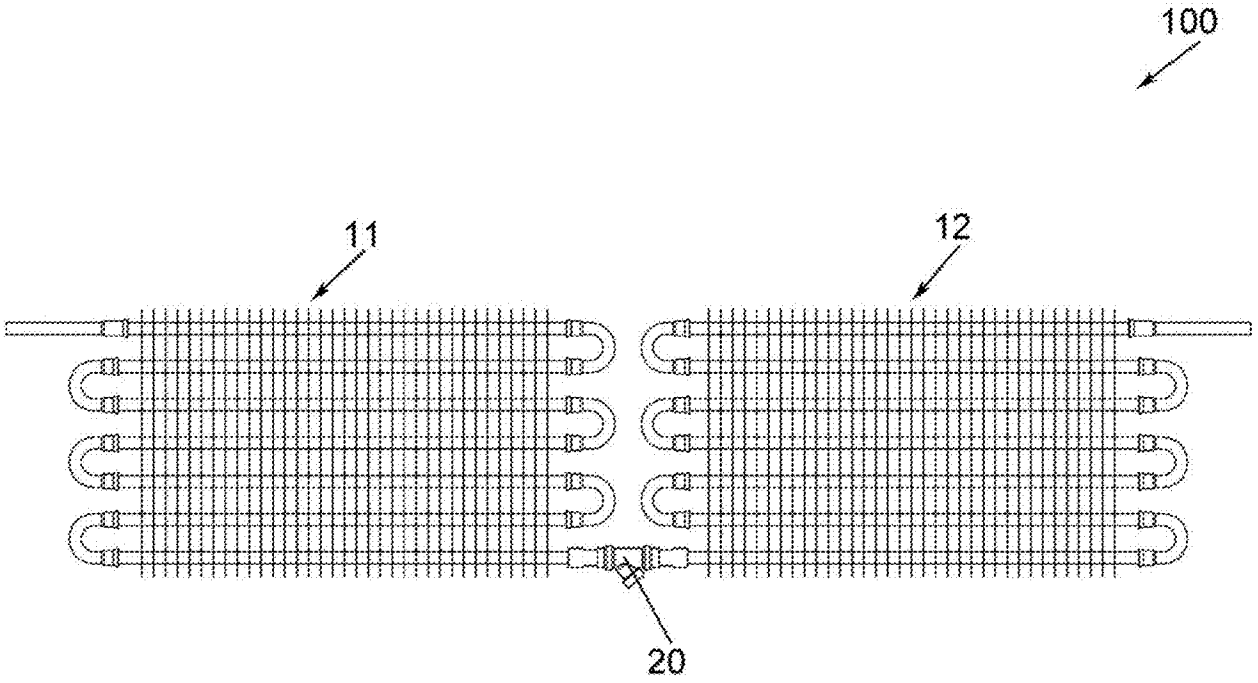
FIG. 8 is a schematic diagram of a heat exchanger assembly according to yet another variant of another embodiment of the present invention.

Referring to FIG. 5 to FIG. 8, in some embodiments of the present invention, the first heat exchanger portion 11 and the second heat exchanger portion 12 are two heat exchangers, and the control valve 20 is connected between the two heat exchangers to connect them in series. As shown in FIG. 5 to FIG. 8, the first heat exchanger portion 11 and the second heat exchanger portion may be arranged in a top-down direction or in a side-to-side direction. It is understandable that the first heat exchanger portion 11 and the second heat exchanger portion may also be arranged one in front of the other. At least one of the two heat exchangers may be a microchannel heat exchanger or a finned tube heat exchanger. In the embodiments shown in FIG. 5 and FIG. 6, the first heat exchanger portion 11 and the second heat exchanger portion 12 are two heat exchangers, wherein the heat exchanger functioning as the first heat exchanger portion 11 and the heat exchanger functioning as the second heat exchanger portion 12 are microchannel heat exchangers. In the embodiments shown in FIG. 7 and FIG. 8, the first heat exchanger portion 11 and the second heat exchanger portion 12 are two heat exchangers, wherein the heat exchanger functioning as the first heat exchanger portion 11 and the heat exchanger functioning as the second heat exchanger portion 12 are finned tube heat exchangers. In the embodiments shown in FIG. 2 to FIG. 6, the heat exchange tubes are straight, and it is understandable that the heat exchange tubes may also be folded in serpentine shapes in top-down directions as shown in FIG. 7 and FIG. 8, with adjacent folded parts being spaced apart by a certain distance, between which fins 14 may be provided. A serpentine heat exchange tube may be formed by bending a straight heat exchange tube, or by connecting a plurality of heat exchange tubes with a U-shaped connecting tube. The first heat exchanger portion 11 and the second heat exchanger portion 12 respectively comprise one or more heat exchange tubes. The header tubes 15 shown in FIG. 2 to FIG. 6 are for illustrative purposes only. A header tube of the present invention refers to a component connected to a heat exchange tube and having a cavity for distributing or receiving a heat exchange medium to or from the heat exchange tube.

An air conditioning system according to an embodiment of the present invention will be described below.

Referring to FIG. 1, an air conditioning system 1000 according to an embodiment of the present invention comprises a reheater 100A, the reheater 100A being a heat exchanger assembly 100 as described above. The air conditioning system 1000 may further comprise a compressor 200; a first heat exchanger 300 functioning as one of a condenser and an evaporator; and a second heat exchanger 400 functioning as the other of a condenser and an evaporator. The compressor 200, the first heat exchanger 300, and the second heat exchanger 400 are connected in sequence from the compressor 200 through the first heat exchanger 300 to the second heat exchanger 400. The reheater 100A is connected in parallel to the first heat exchanger 300. The air conditioning system 1000 may further comprise a throttling device 500, for example, an expansion valve. In FIG. 1, the arrow indicates the direction of refrigerant flow when the air conditioning system 1000 operates in the reheating mode.

Referring to FIG. 1, in some embodiments of the present invention, in the refrigeration mode, the first heat exchanger 300 functions as a condenser, the second heat exchanger 400 functions as an evaporator, the control valve 600 allows the refrigerant from the compressor 200 to flow to the first heat exchanger 300 and forbids the refrigerant from the compressor 200 from flowing to the reheater 100A, the reheater 100A does not operate, and the control valve 20 of the reheater 100A is closed, so that a portion of the refrigerant flowing from the first heat exchanger 300 to the second heat exchanger 400 flows into the second heat exchanger portion 12 of the reheater 100A. For example, a portion of the refrigerant flowing from the first heat exchanger 300 to the throttling device 500 flows into the second heat exchanger portion 12 of the reheater 100A and is stored in the second heat exchanger portion 12. In the reheating mode, the first heat exchanger 300 functions as a condenser, the second heat exchanger 400 functions as an evaporator, the control valve 600 allows the refrigerant from the compressor 200 to flow to the first heat exchanger 300 and also allows the refrigerant from the compressor 200 to flow to the reheater 100A, the reheater 100A operates, and the control valve 20 of the reheater 100A opens, so that the refrigerant flows into the first heat exchanger portion 11 of the reheater 100A and flows from the first heat exchanger portion 11 into the second heat exchanger portion 12 by means of the control valve 20. Finally, the refrigerant flows out from the second heat exchanger portion 12.

Referring to FIG. 2 to FIG. 6, in some embodiments of the present invention, the first heat exchanger portion 11 is arranged above the second heat exchanger portion 12. In the embodiments shown in FIG. 5 and FIG. 6, the first heat exchanger portion 11 and the second heat exchanger portion 12 are two heat exchangers, and the heat exchanger functioning as the first heat exchanger portion 11 is arranged above the heat exchanger functioning as the second heat exchanger portion 12. In the embodiments shown in FIG. 7 and FIG. 8, the first heat exchanger portion 11 and the second heat exchanger portion 12 are two heat exchangers arranged side by side in a horizontal direction.

An air conditioning system having a reheater can operate in a refrigeration mode and a reheating mode. If the amount of refrigerant in the refrigeration mode is appropriate, then in the reheating mode, a portion of the refrigerant needs to be diverted to the reheater, which results in the refrigerant in the condenser being insufficient, triggering the low-pressure protection of the air conditioning system and causing the air conditioning system to stop operating.

According to an embodiment of the present invention, a reheater has the function of storing a refrigerant in the refrigeration mode. In the refrigeration mode, a reheater stores a portion of a refrigerant. In the reheating mode, there is no need to divert the refrigerant of the condenser, which avoids risks of low-pressure protection being caused by a lack of refrigerant and consequently the air conditioning system stopping operation, while ensuring the heat exchange capacity of the condenser.

Referring to FIG. 1, with an air conditioning system according to an embodiment of the present invention, in the reheating mode, the reheater 100A operates and the control valve 20 of the reheater 100A is open, so that the air conditioning system operates properly, and the first heat exchanger portion 11 and the second heat exchanger portion 12 exchange heat properly. In the refrigeration mode, the reheater 100A does not operate and the control valve 20 of the reheater 100A is closed, so that a portion of the refrigerant flowing from the first heat exchanger 300 to the second heat exchanger 400 flows back to the second heat exchanger portion 12 of the reheater 100A through the outlet of the reheater 100A. Since the control valve 20 is closed, this portion of refrigerant is stored in the second heat exchanger portion 12 of the reheater 100A.

Figure 9:
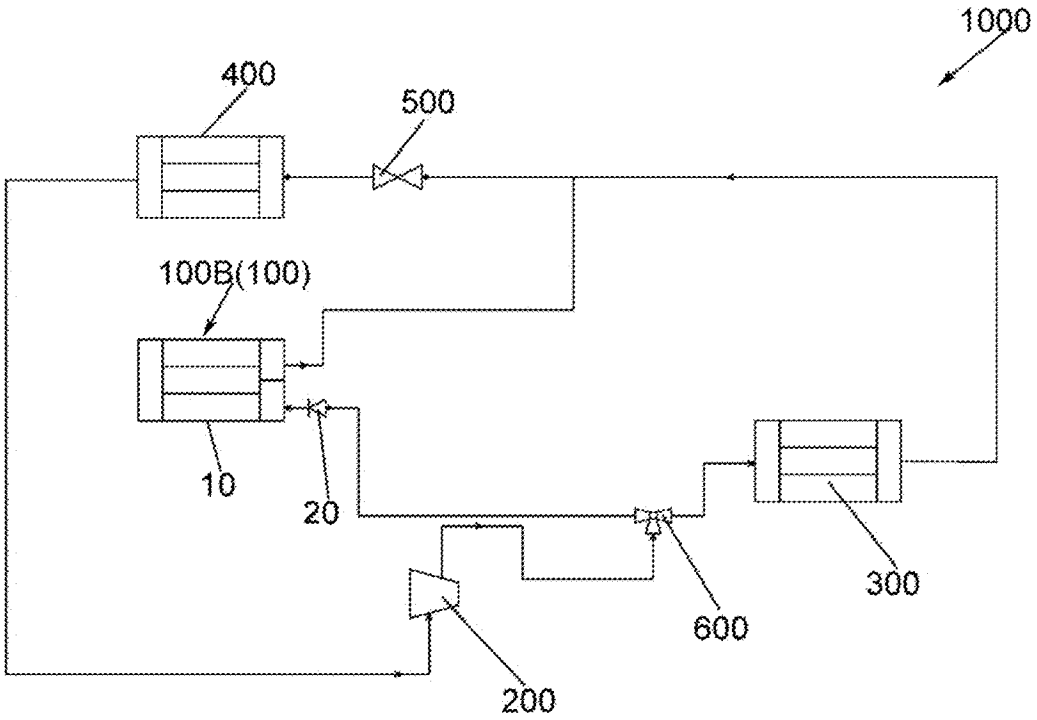
FIG. 9 is a schematic diagram of an air conditioning system according to a variant of an embodiment of the present invention.

Referring to FIG. 9, a heat exchanger assembly 100 according to a variant of an embodiment of the present invention comprises a heat exchanger 10 having an inlet and an outlet; and a control valve 20 connected to the inlet of the heat exchanger 10 and having an open position and a closed position, wherein, at the open position, the control valve 20 allows a refrigerant to enter the heat exchanger 10 by means of the control valve 20 and the inlet of the heat exchanger 10, and at the closed position, the control valve 20 closes the inlet of the heat exchanger 10. The control valve 20 may be a one-way valve or a two-position two-way valve, etc.

Referring to FIG. 9, an air conditioning system 1000 according to an embodiment of the present invention comprises a reheater 100B, the reheater 100B being a heat exchanger assembly 100 as described above. The air conditioning system 1000 may further comprise a compressor 200; a first heat exchanger 300 functioning as one of a condenser and an evaporator; and a second heat exchanger 400 functioning as the other of a condenser and an evaporator. The compressor 200, the first heat exchanger 300, and the second heat exchanger 400 are connected in sequence from the compressor 200 through the first heat exchanger 300 to the second heat exchanger 400. The reheater 100A is connected in parallel to the first heat exchanger 300. The air conditioning system 1000 may further comprise a throttling device 500, for example, an expansion valve. In FIG. 9, the arrow indicates the direction of refrigerant flow when the air conditioning system 1000 operates in the reheating mode.

Referring to FIG. 9, in some embodiments of the present invention, in the refrigeration mode, the first heat exchanger 300 functions as a condenser, the second heat exchanger 400 functions as an evaporator, the control valve 600 allows the refrigerant from the compressor 200 to flow to the first heat exchanger 300 and forbids the refrigerant from the compressor 200 from flowing to the reheater 100B, the reheater 100B does not operate, and the control valve 20 of the reheater 100B is closed, so that a portion of the refrigerant flowing from the first heat exchanger 300 to the second heat exchanger 400 flows into the reheater 100B and is stored in the reheater 100B. For example, a portion of the refrigerant flowing from the first heat exchanger 300 to the throttling device 500 flows into the reheater 100B and is stored in the reheater 100B. In the reheating mode, the first heat exchanger 300 functions as a condenser, the second heat exchanger 400 functions as an evaporator, the control valve 600 allows the refrigerant from the compressor 200 to flow to the first heat exchanger 300 and also allows the refrigerant from the compressor 200 to flow to the reheater 100B, the reheater 100B operates, and the control valve 20 of the reheater 100A opens, so that the refrigerant flows into the reheater 100B by means of the control valve 20.

Referring to FIG. 1 and FIG. 9, an air conditioning system 1000 according to an embodiment of the present invention comprises a compressor 200; a first heat exchanger 300 functioning as one of a condenser and an evaporator; a second heat exchanger 400 functioning as the other of a condenser and an evaporator; and reheaters 100A and 100B, which are connected in parallel to the first heat exchanger 300. The compressor 200, the first heat exchanger 300, and the second heat exchanger 400 are connected in sequence from the compressor 200 through the first heat exchanger 300 to the second heat exchanger 400, and in the refrigeration mode, the first heat exchanger 300 functions as a condenser, the second heat exchanger 400 functions as an evaporator, and neither the reheater 100A nor the reheater 100B operates, so that a portion of the refrigerant flowing from the first heat exchanger 300 to the second heat exchanger 400 flows into the reheaters 100A and 100B and is stored in at least a portion of the reheaters 100A and 100B. The reheater 100A or 100B may be a heat exchanger assembly 100 as described above.

With an air conditioning system according to an embodiment of the present invention, a reheater has the function of storing a refrigerant when the air conditioning system is in the refrigeration mode, so that the refrigerant may be stored in at least a portion of the reheater, which ensures the amounts of refrigerant required by the air conditioning system in the refrigeration mode and the reheating mode, thereby ensuring heat exchange performance in each mode. In addition, using a heat exchanger assembly according to an embodiment of the present invention does not add any extra components to the air conditioning system.

For the air conditioning system shown in FIG. 9, in the refrigeration mode, the entire reheater may be used to store a refrigerant, allowing the air conditioning system to store more refrigerant. This is beneficial when the air conditioning system needs to store a large amount of refrigerant.

For the air conditioning system shown in FIG. 1 and the heat exchanger assemblies shown in FIG. 2 to FIG. 8, a refrigerant is stored in the second heat exchanger portion of a heat exchanger in the refrigeration mode as long as the need of the air conditioning system is met, which can save refrigerant.

Although the above embodiments have been described, certain features in the above embodiments can be combined to form new embodiments.

Furthermore, although embodiments of the present invention have already been described, the above embodiments are merely examples used for facilitating understanding of the present invention, and are not used for limitation. Those skilled in the art may modify the above embodiments without departing from the spirit and scope of the present invention.

What is claimed is:

1. A heat exchanger assembly comprising:

a first heat exchanger portion and a second heat exchanger portion; and a control valve, the control valve having an open position and a closed position, at the open position, the first heat exchanger portion being in fluid communication with the second heat exchanger portion by means of the control valve, and at the closed position, the first heat exchanger portion being in fluid isolation with the second heat exchanger portion by means of the control valve;

wherein the first heat exchanger portion and the second heat exchanger portion are respectively a first heat exchanger portion and a second heat exchanger portion of a heat exchanger, the heat exchanger comprising a plurality of heat exchange tubes and two header tubes connected to the two ends of each heat exchange tube and in fluid communication with each other, wherein each of the two header tubes comprises a first header tube portion and a second header tube portion that are in fluid isolation from each other, so that the heat exchanger is separated into a first heat exchanger portion and a second heat exchanger portion that are in fluid isolation from each other, and the control valve connects the first header tube portion and the second header tube portion of one of the two header tubes to connect the first heat exchanger portion and the second heat exchanger portion in series;

wherein the control valve is arranged outside one header tube of the two header tubes and connected to the first header tube portion and the second header tube portion of the one header tube of the two header tubes through a connecting tube; and the heat exchanger assembly further comprising a first storage container, the first storage container being in fluid communication with the second header tube portion of the one header tube of the two header tubes and connected between the control valve and the second header tube portion of the one header tube of the two header tubes.

2. The heat exchanger assembly as claimed in claim 1, wherein:

the heat exchanger further comprises a partition arranged in each of the two header tubes, the partition separating each header tube into the first header tube portion and the second header tube portion that are in fluid isolation from each other.

3. The heat exchanger assembly as claimed in claim 2, wherein:

the control valve is arranged inside one header tube of the two header tubes and installed on the partition inside the one header tube of the two header tubes.

4. The heat exchanger assembly as claimed in claim 1, wherein:

the heat exchanger further comprises a partition arranged in one of the two header tubes, the partition separating the first header tube into the first header tube portion and the second header tube portion that are in fluid isolation from each other, and the first header tube portion and the second header tube portion of the other of the two header tubes are two subheader tubes that are in fluid isolation from each other.

5. The heat exchanger assembly as claimed in claim 1, wherein:

the first header tube portion and the second header tube portion of one header tube of the two header tubes are two subheader tubes that are in fluid isolation from each other, and the heat exchanger further comprises a partition arranged in the other header tube of the two header tubes, the partition separating the other header tube of the two header tubes into the first header tube portion and the second header tube portion that are in fluid isolation from each other.

6. The heat exchanger assembly as claimed in claim 1, further comprising:

a second storage container, the second storage container being in fluid communication with the second header tube portion of the other header tube of the two header tubes, wherein the outlet of the heat exchanger is arranged on the second storage container.

7. The heat exchanger assembly as claimed in claim 1, wherein:

the first heat exchanger portion and the second heat exchanger portion are two heat exchangers, and the control valve is connected between the two heat exchangers to connect them in series.

8. An air conditioning system, comprising:

a reheater, which is a heat exchanger assembly as claimed in claim 1.

9. The air conditioning system as claimed in claim 8, further comprising:

a compressor;

a first heat exchanger functioning as one of a condenser and an evaporator; and a second heat exchanger functioning as the other of a condenser and an evaporator;

wherein the compressor, the first heat exchanger, and the second heat exchanger are connected in sequence from the compressor through the first heat exchanger to the second heat exchanger, and wherein the reheater is connected in parallel to the first heat exchanger.

10. The air conditioning system as claimed in claim 9, wherein:

in the refrigeration mode, the first heat exchanger functions as a condenser and the second heat exchanger functions as an evaporator, the reheater does not operate and the control valve of the reheater is closed, so that a portion of the refrigerant flowing from the first heat exchanger to the second heat exchanger flows into the second heat exchanger portion of the reheater and is stored in the second heat exchanger portion.

11. The air conditioning system as claimed in claim 9, wherein:

in the reheating mode, the first heat exchanger functions as a condenser and the second heat exchanger functions as an evaporator, the reheater operates and the control valve of the reheater opens, so that the refrigerant flows into the first heat exchanger portion of the reheater and from the first heat exchanger portion to the second heat exchanger portion by means of the control valve.

12. An air conditioning system comprising:

a reheater comprising:

a reheater heat exchanger having an inlet and an outlet; and a control valve connected to the inlet of the reheater heat exchanger and having an open position and a closed position, wherein, at the open position, the control valve allows a refrigerant to enter the reheater heat exchanger by means of the control valve and the inlet of the reheater heat exchanger, and at the closed position, the control valve closes the inlet of the reheater heat exchanger;

a compressor;

a first heat exchanger functioning as one of a condenser and an evaporator; and a second heat exchanger functioning as the other of a condenser and an evaporator;

wherein the compressor, the first heat exchanger, and the second heat exchanger are connected in sequence from the compressor through the first heat exchanger to the second heat exchanger, wherein the reheater is connected in parallel to the first heat exchanger, and wherein the reheater includes one connection line terminating between the compressor and the first heat exchanger, and another connection line terminating between the first heat exchanger and the second heat exchanger.

13. The air conditioning system as claimed in claim 12, wherein:

in the refrigeration mode, the first heat exchanger functions as a condenser and the second heat exchanger functions as an evaporator, the reheater does not operate and the control valve of the reheater is closed, so that a portion of the refrigerant flowing from the first heat exchanger to the second heat exchanger is diverted into the reheater and stored in the reheater.

14. The air conditioning system as claimed in claim 12, wherein:

in the reheating mode, the first heat exchanger functions as a condenser, and the second heat exchanger functions as an evaporator, the reheater operates and the control valve of the reheater opens, so that the refrigerant flows into the reheater by means of the control valve.

15. An air conditioning system, comprising:

a compressor;

a first heat exchanger functioning as one of a condenser and an evaporator;

a second heat exchanger functioning as the other of a condenser and an evaporator; and a reheater connected in parallel to a first heat exchanger;

wherein the compressor, the first heat exchanger, and the second heat exchanger are connected in sequence from the compressor through the first heat exchanger to the second heat exchanger, and wherein the air conditioning system is configured such that, when operating in a refrigeration mode, the first heat exchanger functions as a condenser and the second heat exchanger functions as an evaporator, and the reheater does not operate, so that a portion of the refrigerant flowing from the first heat exchanger to the second heat exchanger flows into the reheater and is stored in at least a portion of the reheater.

16. The air conditioning system as claimed in claim 15, wherein:

the reheater comprises:

a first heat exchanger portion and a second heat exchanger portion; and a control valve, the control valve having an open position and a closed position, at the open position, the first heat exchanger portion being in fluid communication with the second heat exchanger portion by means of the control valve, and at the closed position, the first heat exchanger portion being in fluid isolation with the second heat exchanger portion by means of the control valve.

17. The air conditioning system as claimed in claim 16, wherein:

the air conditioning system is configured such that, when operating in a reheating mode, the first heat exchanger functions as a condenser and the second heat exchanger functions as an evaporator, the reheater operates and the control valve of the reheater opens, so that the refrigerant flows into the first heat exchanger portion of the reheater and from the first heat exchanger portion to the second heat exchanger portion by means of the control valve.

18. The air conditioning system as claimed in claim 16, wherein:

the reheater comprises a plurality of heat exchange tubes and two header tubes connected to the two ends of each heat exchange tube and in fluid communication with each other, wherein each of the two header tubes comprises a first header tube portion and a second header tube portion that are in fluid isolation from each other, so that the reheater is separated into a first heat exchanger portion and a second heat exchanger portion that are in fluid isolation from each other, and the control valve connects the first header tube portion and the second header tube portion of one of the two header tubes to connect the first heat exchanger portion and the second heat exchanger portion in series.

19. The air conditioning system as claimed in claim 18, wherein:

the reheater further comprises a partition arranged in each of the two header tubes, the partition separating each header tube into the first header tube portion and the second header tube portion that are in fluid isolation from each other.

20. The air conditioning system as claimed in claim 18, wherein:

the reheater further comprises a partition arranged in one of the two header tubes, the partition separating the first header tube into the first header tube portion and the second header tube portion that are in fluid isolation from each other, and the first header tube portion and the second header tube portion of the other of the two header tubes are two subheader tubes that are in fluid isolation from each other.

* * * * *